United States Patent [19]

Vogels

[11] Patent Number: 4,534,728

[45] Date of Patent: Aug. 13, 1985

[54] COMBINATION GAS ENRICHER, SPARK IGNITER, FLAME SENSOR

[75] Inventor: Joseph A. Vogels, Long Beach, Calif.

[73] Assignee: Honeywell Inc., Minneapolis, Minn.

[21] Appl. No.: 595,878

[22] Filed: Apr. 2, 1984

[51] Int. Cl.[3] ..... F23N 5/10

[52] U.S. Cl. ..... 431/80; 431/25; 431/46

[58] Field of Search ..... 431/25, 46, 66, 71, 431/74, 78, 12, 90, 254, 264, 281; 236/1 EA, 1 H; 340/579; 361/253, 261; 137/65

[56] References Cited

U.S. PATENT DOCUMENTS

| | | | |
|---|---|---|---|
| 1,914,949 | 6/1933 | Hardgrove | 431/90 X |
| 3,224,487 | 12/1965 | McInerney et al. . | |
| 3,291,183 | 12/1966 | Fairley . | |
| 3,955,910 | 5/1976 | Matthews | 431/25 |
| 4,137,035 | 1/1979 | Cade | 431/46 X |
| 4,188,182 | 2/1980 | Junak | 431/25 X |
| 4,197,082 | 4/1980 | Matthews . | |
| 4,238,184 | 12/1980 | Schilling . | |
| 4,269,589 | 5/1981 | Matthews . | |
| 4,304,545 | 12/1981 | Matthews | 431/25 |

OTHER PUBLICATIONS

S87D Direct Spark Ignition Control Module, Honeywell Tradeline Catalog, 1982–1983, p. 46.

*Primary Examiner*—Randall L. Green
*Attorney, Agent, or Firm*—Clyde C. Blinn

[57] ABSTRACT

Apparatus mounted adjacent a gas burner comprising a tube attached to a high voltage electrode to form a spark gap of high voltage gas ignition and flame proving system wherein raw gas is supplied through the tube to enrich the gas mixture to a lower air to gas ratio around the spark gap to enhance ignition.

3 Claims, 2 Drawing Figures

COMBINATION GAS ENRICHER, SPARK IGNITER, FLAME SENSOR

BACKGROUND AND SUMMARY OF THE INVENTION

The construction of many gas burning apparatuses require that the gas-air mixture escaping from the burners is very lean. A lean mixture is defined as a low percent of gas with respect to air. Often the percentage of gas can be so low that the mixture comes close to the lower limit of flamability. The closer the mixture is to the limit of flamability the higher the required spark energy for ignition will be. The required spark energy can become prohibitive to the application of any ignition control on the market.

A gas apparatus of this construction might have a direct spark ignition control of the type manufactured and sold by Honeywell Inc. as the S87D Direct Spark Ignition Control Module wherein, upon energization of the burner, a spark electrode provides a spark to ignite the gas and once the flame is present a flame detection system turns off the ignition system. In order to enhance the ignition, raw or pure gas has been admitted in the vicinity of the electrode to enrich the gas-air mixture which reduces the required ignition energy.

Recognizing the need for enriching the gas in the vicinity of the ignition system spark to reduce the required spark energy, the present invention is concerned with an improvement in the ignition apparatus. A unit made up of a conductive tube or pipe attached adjacent to a high voltage electrode by an insulating member provides the spark portion of the ignition system. With such a unit, the unit can be easily installed on a gas heater such as a radiant gas burner, with a minimum effort, ensuring that the spacing of the electrode from the grounded tube and the admittance of raw gas to the area are adequate to provide ignition from a particular ignition system.

DESCRIPTION OF THE INVENTION

Figure 1:
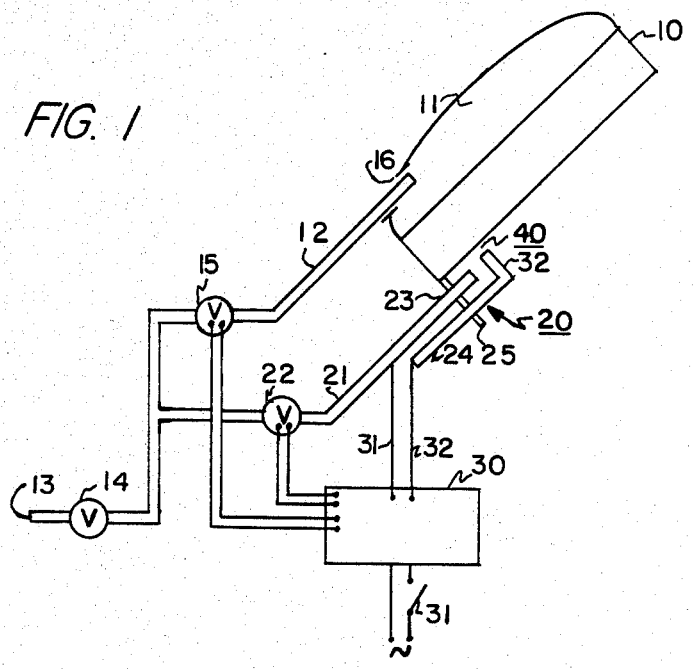
FIG. 1 is a showing of the improved ignition and flame detection unit mounted for controlling the ignition of a gas burner of a radiant heater.

Referring to FIG. 1, a fuel or gas heater or temperature conditioning apparatus 10 has a main burner 11 to which gas is supplied through a pipe or raw gas supply conduit 12 from a source of gas 13 when manual valve 14 and valve 15 are open. Induced air to burner 11 enters opening 16 to provide high air to gas ratio mixture for best efficiency of heater 10. Valve 14 is a main shut-off cock and is normally open during the heating season. An ignition and flame detection unit 20 is mounted on heater 10. Unit 20 is connected to the source of gas through pipe 21 and valve 22. Unit 20 comprises a pipe 23 and an electrode 24 mounted on an insulating member 25 which is attached to heater 10.

A control apparatus 30 comprises an ignition system and a flame detection system and has an output circuit of wires 31 and 32 connected to the ground or pipe 23 and electrode 24, respectively. Control apparatus is of the type known as the S87D Direct Spark Ignition Control Module manufactured by Honeywell Inc. or the type disclosed in the Roger A. Schilling U.S. Pat. No. 4,238,184, issued Dec. 9, 1980.

Upon the closure of switch 31 to energize control apparatus 30, main valve 15 is opened to supply gas to burner 11 and valve 22 is opened to supply pure or raw gas in the vicinity of electrode 24. At the same time a high voltage source is applied to conductors 31 and 32 to provide an ignition spark between an end portion 32 of electrode 24 and pipe 23 to ignite the gas flow from burner 11.

Figure 2:
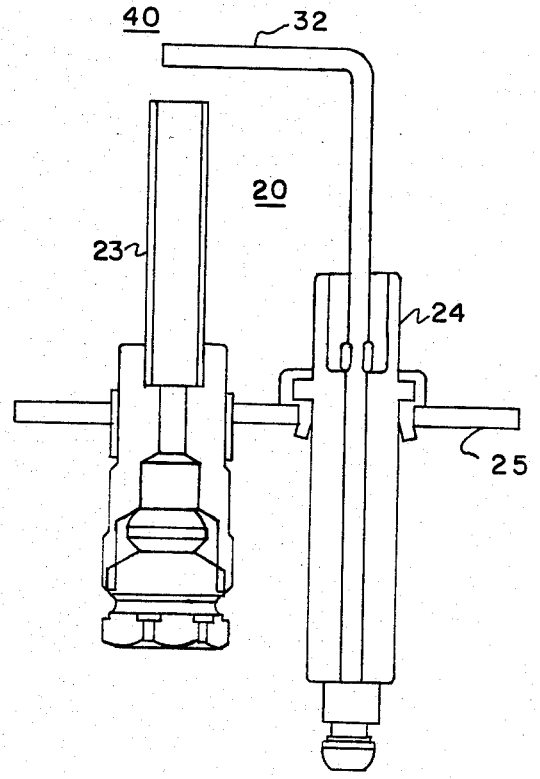
FIG. 2 is a detailed showing of the unit including the pipe for supplying raw gas and for supporting the ignition spark from the connected electrode.

Referring to FIG. 2, a more detailed showing of the ignition and flame detection unit 20 is shown. Pipe 23 supplies the raw gas in the vicinity or area 40 of the electrode 32 so that, upon the application of power from the control apparatus 30, a spark between the electrode 32 and pipe 23 ignites the gas mixture in area 40 which has a much lower air to fuel ratio or a richer gas mixture due to the presence of the raw gas from pipe 23 which is added to the gas mixture of the burner 11.

OPERATION OF THE INVENTION

Upon the energization of the control apparatus 30 by closing switch 31, as shown in FIG. 1, the main burner receives gas through valve 15. Burner 11 is of the type that is supplied with air, such as being induced through opening 16 to the burner so that a high air to fuel ratio or lean gas mixture exists. Ignition of such a lean gas mixture requires considerable electrical power to produce a hot spark sufficient to bring about ignition. To decrease the air to fuel ratio, raw gas is admitted through pipe 23 in the area 40 of the ignition electrode 32. Simultaneously, control apparatus 30 provides a high voltage to conductors 31 and 32 to provide the ignition spark. Upon ignition of the gas mixture, control apparatus 30 senses the presence of flame surrounding pipe 23 and electrode 32 as taught in the Schilling patent to provide a flame detection signal to control apparatus 30 for turning off the valve 22.

Unit 20 can be manufactured with certain size limitations and dimensions, including electrode spacing and pipe size, for best operation and sold as a unit. Upon delivery to a temperature conditioning apparatus or heater manufacture, unit 20 can be easily mounted, not requiring specific adjustments for the required operation, to ensure the desired performance with a heater 10.

The embodiments of the invention in which an exclusive property or right is claimed are defined as follows:

1. An improvement in an electrical ignition apparatus for igniting a main gas burner being supplied with an air and gas mixture having a high air to gas ratio wherein an air to gas ratio is reduced in an area where the electrical ignition apparatus produces an ignition spark to enhance ignition with less ignition power, the improvement comprising a gas supply pipe and an igniter electrode connected by an insulating material to form a single unit adapted to be mounted adjacent a main burner receiving a gas mixture having a high air to gas ratio, said gas supply pipe being adapted to be connected to a source of gas under pressure for furnishing pure gas to the area where a spark is to occur to reduce said air to gas ratio, a source of high voltage having two output terminals for producing an ignition spark, and means connecting one of said output terminals to said igniter electrode and a second of said output terminals to said pipe whereby said ignition spark generated between said electrode and said pipe is surrounded by an air and gas mixture with a lower air to gas ratio than the gas mixture furnished to the main burner to enhance ignition of the main burner gas mixture.

2. A low power ignition apparatus adapted for use to ignite a main gas burner of a space temperature conditioning apparatus being supplied with a mixture of combustion gas having a high air to gas ratio, comprising:

conduit means connected to a source of pure gas and mounted adjacent the gas burner to enrich a gas and air mixture in the area where an iginition spark is to occur, an igniter electrode physically attached to and electrically insulated from said conduit means to form a single unit of said conduit means and said electrode, and a control apparatus having a source of high voltages having two terminals, a first terminal being connected to said electrode and a second terminal to said conduit means whereby for the ignition of the main burner, a spark is generated between said electrode and said conduit to ignite the gas mixture having a higher gas to air ratio which is in the vicinity of said electrode.

3. The invention of claim 2, wherein said control apparatus further comprises means responsive to current flow between said electrode and said conduit caused by the presence of a burner flame therebetween to prove that ignition of the burner gas mixture takes place and for terminating said high voltage to said electrode.

* * * * *